United States Patent [19]

Bereuter

[11] 4,144,182

[45] Mar. 13, 1979

[54] SALTS OF ALKYLENEDIAMINE CARBOXYLIC ACIDS AND AQUEOUS SOLUTIONS THEREOF

[76] Inventor: Heinz Bereuter, An der Steinlache 10, Hard, Austria, 6971

[21] Appl. No.: 813,968

[22] Filed: Jul. 8, 1977

[51] Int. Cl.[2] ..... C10M 1/32; C09F 5/00

[52] U.S. Cl. ..... 252/34; 252/41; 252/49.3; 252/51.5 A; 260/404.5

[58] Field of Search ..... 260/404.5 PA; 252/34, 252/41, 49.3, 51.5 A

[56] References Cited

U.S. PATENT DOCUMENTS

| | | | |
|---|---|---|---|
| 2,781,370 | 2/1957 | Mannheimer | 260/404.5 PA |
| 2,828,262 | 3/1958 | Morway | 260/404.5 |
| 2,941,943 | 6/1960 | Kirkpatrick | 260/404.5 |
| 3,278,430 | 10/1966 | Williams | 252/49.3 |
| 3,801,609 | 4/1974 | Magne | 252/51.5 A |

*Primary Examiner*—John F. Niebling
*Attorney, Agent, or Firm*—Hans Berman

[57] ABSTRACT

Aqueous solutions of salts of alkylenediaminecarboxylic acids of the formula

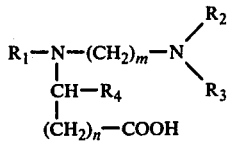

such as N-isononanoyl-ethylenediamine-N, N'-diacetic acid are effective coolants and lubricants for the machining and other working of metals and inhibit the corrosion of ferrous metals. The salts are biodegradable.

3 Claims, No Drawings

SALTS OF ALKYLENEDIAMINE CARBOXYLIC ACIDS AND AQUEOUS SOLUTIONS THEREOF

This invention relates to the working of metals and particularly to agents whose aqueous solutions cool and lubricate metals that are being machined or worked otherwise.

The water soluble salts of alkyl and alkylaryl sulfonates, and corresponding salts of alkylsulfonamidocarboxylic acids have been used heretofore as cooling, lubricating, and corrosion inhibiting agents for metals that are being machined. While often effective, the known metal working agents of the types mentioned are phytotoxic and are not or not readily biodegradable.

It is a primary object of this invention to provide metal working agents having the desirable properties of the afore-mentioned known compounds, but being readily biodegradable.

It has now been found that aqueous solutions of acids of the formula

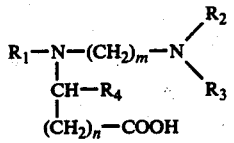

in at least stoichiometric amounts of inorganic or organic bases have excellent lubricating effects on metals that are being machined or worked without cutting, inhibit the corrosion of ferrous workpieces, do not foam excessively, and are readily degraded by microorganisms if $R_1$ is alkanoyl or alkenoyl having 6 to 20 carbon atoms;
$R_2$ is hydrogen, $R_1$, or $-(CH-R_4)-(CH_2)_n-COOH$;
$R_3$ is $-(CH-R_4)-(CH_2)_n-COOH$,
$-[(CH_2)_m-(N-R_2)]_z-(CH-R_4)-(CH_2)_n-COOH$,
or

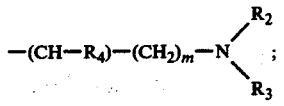

$R_4$ is alkyl having 1 to 3 carbon atoms or hydrogen;
m is an integer between 2 and 6;
n is 0, 1, or 2; and
z is an integer between 1 and 6.

The compounds are prepared in a known manner illustrated by the following Example:

EXAMPLE 1

100 g (1 Mol) ethyl acrylate was added dropwise to 30 g (0.5 mol) ethylenediamine with stirring while the temperature of the mixture was held at 20° to 50° C. by external cooling. The reaction product was diluted with 300 ml ethyl ether and 100 ml pyridine. 180 g (1 Mol) isononanoyl chloride was added dropwise at 20° C., and the ether layer thereafter was washed with water until free from pyridine. The ether was distilled off, and 550 ml 2-N sodium hydroxide solution was added dropwise to the residue at 60° C. A temperature of 60° C. was maintained for one hour after the addition to achieve saponification. When the saponification mixture was acidified with concentrated hydrochloric acid, a white, crystalline powder was precipitated. It was filtered off with suction, washed with water, and recrystallized from ethanol.

205 g Pure N, N'-diisononanoyl-ethylenediamine-N, N'-dipropionic acid having a melting point of 231° C. was obtained. It had an acid number of 230 (calculated: 231) and contained 5.7% nitrogen (calculated: 5.8%).

Analogous procedures were employed in producing other acids of the invention such as those identified by numbers in the following list for the convenience of reference:

1. N-Isononanoyl-ethylenediamine-N,N'-diacetic acid.
2. N,N'-Diisononanoyl-ethylenediamine-N,N'-diacetic acid.
3. N-Isononanoyl-ethylenediamine-N,N', N'-triacetic acid.
4. N-Caproyl-ethylenediamine-N,N'-diacetic acid.
5. N,N'-Dicaproyl-ethylenediamine-N,N'-diacetic acid.
6. N-Caproyl-ethylenediamine-N,N',N'-triacetic acid.
7. N-Isooctanoyl-ethylenediamine-N,N'-diacetic acid.
8. N,N'-Diisooctanoyl-ethylenediamine-N,N'-diacetic acid.
9. N-Isooctanoyl-ethylenediamine-N,N',N'-triacetic acid.
10. N-Isononanoyl-ethylenediamine-N,N'-dipropionic acid.
11. N,N'-Diisononanoyl-ethylenediamine-N,N'-dipropionic acid.
12. N-Isononanoyl-ethylenediamine-N,N',N'-tripropionic acid.
13. N-Dodecanoyl-propylenediamine-N,N',N'-tripropionic acid.
14. N,N'-Didodecanoyl-propylenediamine-N,N'-dipropionic acid.
15. N-Tridecanoyl-hexamethylenediamine-N,N'-dipropionic acid.
16. N,N'-Tridecanoyl-hexamethyelenediamine-N,N'-dipropionic acid.
17. N-Isooctadecanoyl-propylenediamine-N,N'-di-(3)-butyric acid.
18. N,N'-Diisoactadecanoyl-propylenediamine-N,N'-dibutyric acid.
19. N,N',N''-Triisononanoyl-diethylenetriamine-N,N''-dipropionic acid.
20. N,N''-Diisononanoyl-diethylenetriamine-N,N',N''-tripropionic acid.
21. N,N''-Diisononanoyl-diethylenetriamine-N,N''-dipropionic acid.
22. N-Octadecenoyl-diethylenetriamine-N,N',N''-tripropionic acid.
23. N,N''-Dioctadecenoyl-diethylenetriamine-N,N''-dipropionic acid.
24. N,N'''-Diisononanoyl-triethylenetetramine-N,N',N'',N'''-tetrapropionic acid.
25. N,N',N'''-Triisononanoyl-triethylenetetramine-N,N'',N'''-tripropionic acid.
26. N,N''',N$^{v}$-Triisononanoyl-pentaethylenehexamine-N,N', N'',N'''',N$^{v}$-pentapropionic acid.

The acids of the invention including those specifically referred to above are readily soluble in water in the presence of a stoichiometrically equivalent amount or of an excess of a water-soluble base. The salts with alkali metals, with ammonia, and with organic bases may be employed to advantage. The mono-, di-, and triethanolamines and their condensation complexes with boric acid are preferred because of their favorable combination of low cost with good lubricating and corrosion inhibiting effects.

EXAMPLE 2

Aqueous solutions of pH 8 were prepared from water having a hardness of 20° dH and 5 to 30 g/l of the triethanolamine salts of acids of the invention or of mixtures of such compounds. The solutions were tested for their corrosion inhibiting properties by the method of German Industrial Standard DIN 51360 (filter paper test) which is almost identical with the tentative Institute of Petroleum standard IP 287/72. The corrosion test results are listed in the following Table by numbers indicating no corrosion (0), trace corrosion (1), light corrosion (2), moderate corrosion (3), or severe corrosion (4).

TABLE

| Compound No. | Concentration g/l | Test Result |
|---|---|---|
| 20% (1), 80% (2) | 5 | 2 |
| | 10 | 0 |
| (2) | 5 | 3 |
| | 10 | 2 |
| | 20 | 0 |
| 20% (4), 70% (5), 10% (6) | 20 | 2 |
| | 30 | 0 |
| (5) | 30 | 2 |
| 20% (10), 80% (11) | 7 | 0 |
| (11) | 10 | 0 |
| 20% (13), 80% (14) | 15 | 0 |
| (14) | 20 | 0 |
| 20% (15), 80% (16) | 20 | 0 |
| (19) | 10 | 0 |
| (21) | 10 | 0 |
| (23) | 30 | 0 |
| (25) | 15 | 0 |

For comparison purposes, the benzenesulphonyl-N-methyl-E-aminocaproic acid-triethanolammonium salt disclosed in U.S. Pat. No. 3,556,994 (Compound 5) was subjected to the same test in a concentration of 10 g/l and did not prevent severe corrosion (4). The compounds of the invention listed in the preceding Table were also tested for their lubricating effects by the methods described in the cited patent and compared favorably with the known compounds. The foaming power of the compounds of the invention was significantly lower.

When tested under the same conditions, N,N'-dibenzenesulfonyl-N,N'-bis (carboxypropyl)-1,2-aminoethane-triethanolamine (German published application 2,330,978) obtained a test result of 2 (light corrosion) when used at 10 g/l.

Aqueous solutions of the compounds of the invention are employed in a conventional manner as cooling and lubricating agents. They may amount to as little as 0.1% or as much as 10% of the weight of an aqueous metal working fluid, but concentrations of less than 0.5% are not generally recommended in the absence of the lubricants, and concentrations higher than 3% do not contribute sufficiently to the results achieved to justify the higher cost under most conditions. Petroleum lubricants may be emulsified in the solutions partly to replace or to supplement the compounds of the invention in a manner conventional with other water-soluble metal working agents.

The corrosion inhibiting effect of the compounds of this invention is most beneficial to ferrous metals, but the good lubrication and cooling achieved by the surfactant properties of the compounds are useful in the working of non-ferrous metals as well. Metallic workpieces thus generally benefit from contact of their surfaces with aqueous solutions of the compounds of the invention while such surfaces are being machined or otherwise worked.

What is claimed is:

1. A compound which is an acid of the formula

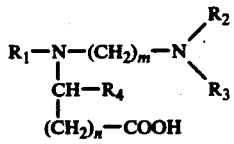

wherein $R_1$ is alkanoyl of a monocarboxylic acid or alkenoyl having 6 to 20 carbon atoms;

$R_2$ is hydrogen, $R_1$, or $-(CH-R_4)-(CH_2)_n-COOH$;

$R_3$ is $-(CH-R_4)-(CH_2)_n-COOH$, $-[(CH_2)_m-(N-R_2)]_z-(CH-R_4)-(CH_2)_n-COOH$, or

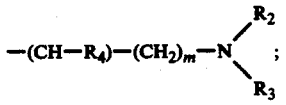

$R_4$ is alkyl having one to three carbon atoms, or hydrogen;

m is an integer between 2 and 6;

n is 0, 1, or 2; and z is an integer between 1 and 6; or a water-soluble salt of said acid.

2. A compound as set forth in claim 1, wherein $R_1$ and $R_2$ are isononanoyl, $R_3$ is $-C_2H_4-COOH$, $R_4$ is hydrogen, m is 2, and n is 1.

3. An aqueous solution of a compound as set forth in claim 1, said compound amounting to 0.1 to 10 percent of the weight of said solution.

* * * * *